United States Patent [19]

Colterjohn, Jr.

[11] Patent Number: 4,877,991

[45] Date of Patent: Oct. 31, 1989

[54] OPTICAL RADIATION SOURCE

[76] Inventor: Walter L. Colterjohn, Jr., 1201 Oak Ridge Cir., Barrington, Ill. 60010

[21] Appl. No.: 135,348

[22] Filed: Dec. 21, 1987

[51] Int. Cl.[4] ..... H01J 61/34; H01J 61/52

[52] U.S. Cl. ..... 313/22; 313/25; 313/36; 313/111; 313/634; 313/638; 313/643

[58] Field of Search ..... 313/17, 36, 25, 111, 313/24, 36, 22, 634, 638, 643

[56] References Cited

U.S. PATENT DOCUMENTS

| | | | |
|---|---|---|---|
| 2,054,846 | 9/1936 | Zillger | 313/113 X |
| 2,135,480 | 11/1938 | Birdseye | 313/635 X |
| 2,154,542 | 4/1939 | Swanson | 313/25 |
| 2,241,968 | 5/1941 | Suits | 313/22 X |
| 2,467,687 | 4/1949 | Noel | 313/22 X |
| 2,977,492 | 3/1961 | Hoekstra | 313/25 X |
| 3,337,763 | 8/1967 | Aronson et al. | 313/22 |
| 3,993,922 | 11/1976 | Cosco et al. | 313/113 X |
| 4,054,812 | 10/1977 | Lessner et al. | 313/111 X |
| 4,506,369 | 3/1985 | Houston | 313/25 X |

*Primary Examiner*—Palmer C. DeMeo

*Attorney, Agent, or Firm*—Laff, Whitesel, Conte & Saret

[57] ABSTRACT

An improved optical radiation source for use in illumination that is obtained from a thinwall tubular arc lamp with a high input power density that delivers high brightness. It includes a constricting enclosure that exerts a compressive force upon the insulating tube forming the envelope of said lamp to counteract tensile strain in the tube caused by higher gas pressure within the tube and a higher thermal gradient within the walls of said tube.

58 Claims, 4 Drawing Sheets

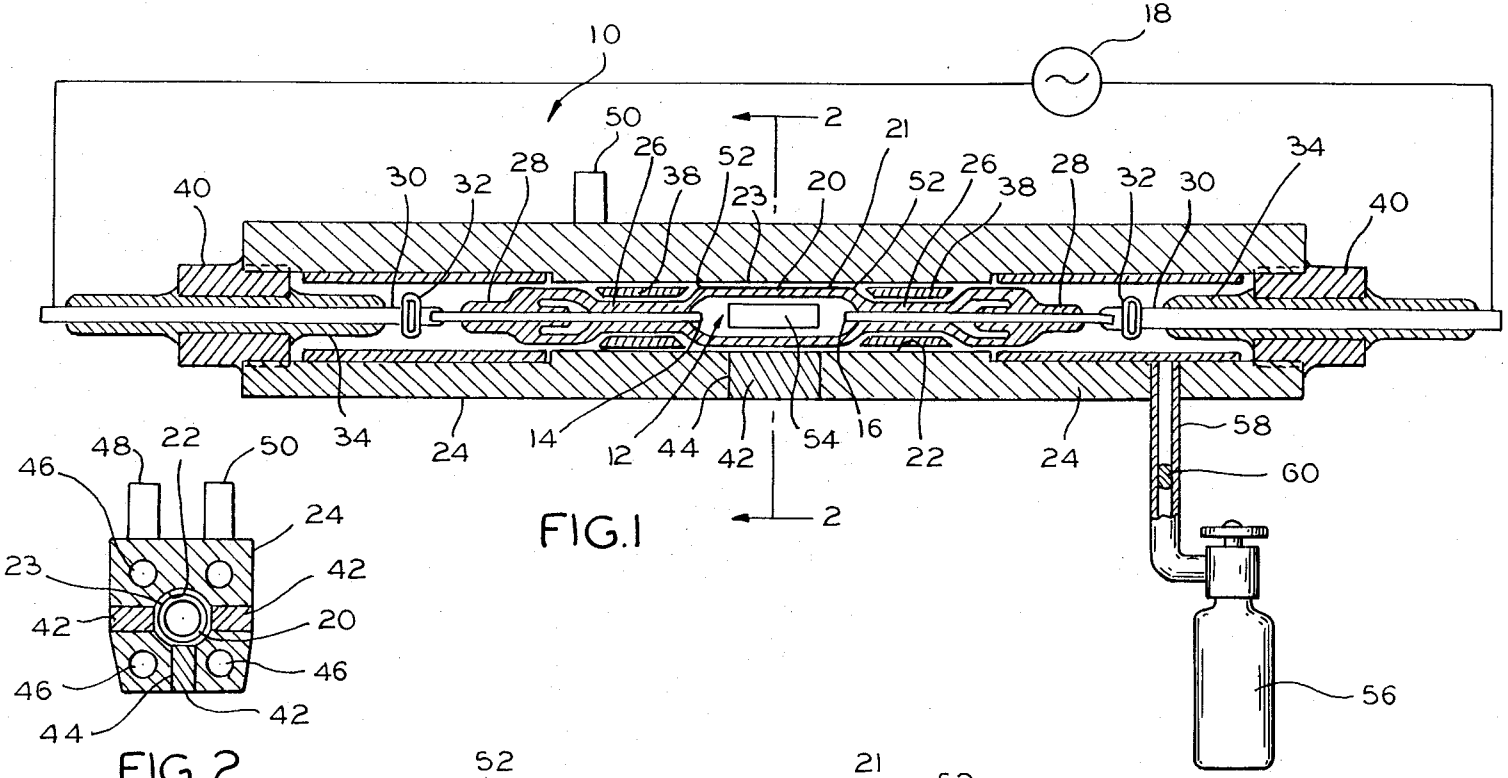
FIG.1
FIG.2
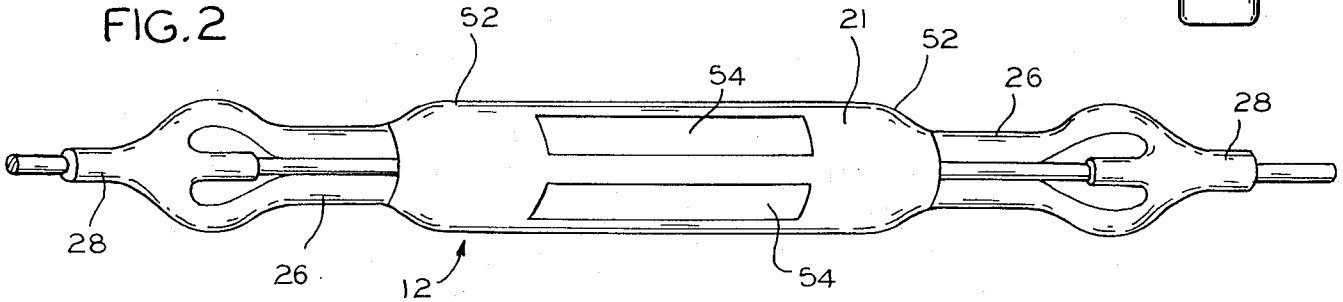
FIG.3

OPTICAL RADIATION SOURCE

This invention relates to an improved optical radiation source for use in illumination. In particular this invention provides a tubular arc lamp with a high input power density that delivers high brightness.

BACKGROUND OF THE INVENTION AND PRIOR ART

For many applications, for example, that of photographic film projection, illuminators are required that are able to deliver as much light as possible into a constricted area of specific size and shape. The light being delivered to such an area must have some maximum angular divergence at each point of the illuminated area such that an associated image projection lens can accept the light for projection. To accomplish this, the initial source of light must have high brightness and the optical system associated with the source must collect the light from the source, control its divergence or collimation and provide for its direction to the area to be illuminated. For the best efficiency the divergence should decrease only in proportion to an increase in the area illuminated.

Because of limitations in the brightness of the initial source of light, or limitations in the associated optical system in collecting, collimating and otherwise directing the light to the area requiring illumination, presently available illuminators are often unable to provide the level of illumination needed.

At the present time, the applications requiring the highest source of brightness available are utilizing short-arc lamps. These short-arc lamps have their electrodes rather closely spaced in a relatively large size fused silica envelope. Normally, xenon gas or mercury vapor at high pressure is used as the excitation gas. These short-arc lamps utilize a high current arc of relatively low voltage, i.e., one hundred amperes at thirty volts is typical for a 3000 watt theater projection lamp. Due to the high current utilized in such lamps the anode dissipation is typically one-third of the input power, which causes some inefficiency in the lamp and requires the anode to be of substantial size to permit adequate cooling.

Short-arc lamps of the type discussed above have utilized a variety of different optical systems. In one such system, for example, light sources for theater projection, the lamp is normally surrounded by an ellipsoidal reflector that directs light at the input aperture of the projection lens. A primary requirement is that the film being projected must be fully illuminated by the radiation passing through the film. Since the beam has a circular section, the beam diameter at the plane of the film must be equal to at least the diagonal measurement of each frame of the film passing by the inlet aperture of the projection lens. Because of this it is required to illuminate an area substantially larger than that of the film. Thus, this optical system, although it is relatively one of the best available, is not as efficient nor has as much brightness as one would like. This is due in part to the need to illuminate an area larger than that of the film frames, but, it is also due to aberrations of the particular optical system as well as some limitations in its ability to efficiently collect the radiation from the short-arc lamp.

Another radiation source are tubular arc lamps with a relatively high ratio between outside and inside diameter which results in them being referred to as capillary arc lamps. Such lamps are also relatively long relative to their diameter. They are used in a number of applications where a high brightness source of light is required, however, these lamps do not have as much brightness as the short-arc lamps. Because of this diminished brightness, relative to the short-arc lamps, and because the high aspect ratio of length to width makes it difficult to illuminate a format of moderate aspect ratio, such as film, their applications have been limited.

On the positive side, however, such capillary arc lamps do have the advantages of low arc current and low anode losses; they can be made in a very compact form; and have the advantage of being relatively inexpensive. However, an additional limitation which has restricted the use of capillary arc lamps is their need for rather intensive cooling due to their small size. They are known to be used immersed in flowing water or, alternatively, with a high pressure air blast cooling them. It will be recognized that both of these procedures present problems. In the case of water flow, the water must be kept pure to avoid deposits on the heated lamp. Deionizing resins as well as the use of other carefully selected materials in the water circulating system are required. On the other hand, the use of high pressure air blasts requires pumps of considerable size and generally results in organic vapor decomposition products depositing on the hot lamps after an extended period of operation.

A further major limitation on the brightness of capillary arc lamps is the thickness of their walls which limits the power input that can be tolerated without causing over heating of the inside surface of the tube. (The amount of power input being directly related to the brightness factor as well as the generation of heat by the arc.) The walls must be thick to withstand the stress due to the high internal gas pressure generated at such elevated temperatures. Capillary lamps normally operate with an OD to ID ratio of at least three to one and are generally made of fused silica. The maximum loading normally used is around fifty watts per millimeter of arc length. At this power level the temperature of the inside of the tube wall can be estimated at 1100 degrees to 1200 degrees Centigrade. Fused silica at this temperature has reduced strength and the outer regions of the tube being at lower temperature are under stress induced by the thermal gradient and by the internal pressure. This stress closely approaches the maximum that can be sustained with little margin for error.

BRIEF SUMMARY OF THE PRESENT INVENTION

It is an object of this invention to provide an optical radiation source to act as an illuminator having a light output characterized by a high brightness.

Another object of this invention is to permit operation of a relatively thin walled tubular arc lamp at a high brightness level and to provide a unique optical system for the collection and output of light from said lamp for high intensity illumination purposes.

A further object of this invention is to provide for the efficient collection of light from a thin walled arc lamp in a compressive enclosure and for the direction thereof to an output aperture of rectangular or other preferred shape, with retention of substantially all of the brightness as well as control of divergence of the output light.

Still another object of the invention is to provide indirect cooling means adapted to remove heat from an arc lamp and its enclosure without causing lamp contamination.

These and other objectives can be achieved by the utilization of an optical radiation source which includes at least two or more of the following:

a tubular arc lamp having a relatively thin wall that improves heat transfer from the inside of that wall to the outside of the wall and away from the lamp;

an enclosure that mounts the lamp internally of the enclosure and exerts pressure, either, by direct contact with the lamp, or, alternatively, by providing a pressurized solid, liquid or gas interface between the lamp and the enclosure so as to pressure encapsulate said lamp and thereby prevent the thin walled lamp from exploding from the combination of stress induced by thermal gradients in the arc lamp walls and high internal gas pressure during operation;

the enclosure including one or more light conduit type windows having an internal surface juxtaposed to the arc lamp to provide for the collection of light from the arc lamp and the transmission of the collected light to the outside of the enclosure;

the interface between the lamp and the enclosure having a reflective surface along the arc length, except for those portions adjacent to the enclosure windows, to improve the efficiency of the illuminator and the brightness of the output by causing most of the light to either exit through the windows or be reabsorbed in the arc by reflection.

In certain embodiments it has been found desirable to incorporate passages or surfaces in the enclosure thereby providing a passageway for the flow of a cooling medium through the enclosure to accomplish thermal transfer. The arc lamp is cooled by heat transfer to the enclosure and the windows. The windows are chosen from materials having good thermal conductivity and transfer the heat they receive from the lamp by being in good thermal contact with the enclosure.

Another approach for cooling the lamp is by causing the pressurized fluid, gas or liquid, disposed as an interface between the lamp and enclosure to flow and transfer heat to a region remote from the lamp.

The illumination source of the present invention normally utilizes optics disposed external to the enclosure to collimate and direct the light transmitted outwardly through the enclosure windows. While a number of arrangements of external optics is possible, depending upon the requirements of a specific application, the disclosed embodiment specifically provided to illustrate this invention consists of plate shaped light conduits, generally with an expanding taper to reduce beam divergence, coupled to the output surfaces of the enclosure windows, either directly or via prisms, and having an orientation parallel to one another, with the output ends of the conduits being combined to provide an output aperture of rectangular shape of a reduced aspect ratio generally configured to accommodate the frame size of a film projector. Further, the output of the light conduits may be provided with a bandpass dielectric filter which serves to pass desired radiation while reflecting other radiation back to the source for reabsorption in the arc.

BRIEF DESCRIPTION OF THE DRAWINGS

FIG. 1 is an elevational view in partial section of a preferred embodiment of the invention illustrating an arc lamp in a pressurized enclosure;

FIG. 2 is a cross sectional view taken along line 2—2 in FIG. 1;

FIG. 3 is a perspective view of an arc lamp of the type contemplated in the embodiment shown in FIG. 1;

DETAILED DESCRIPTION OF THE INVENTION

Figure 4:
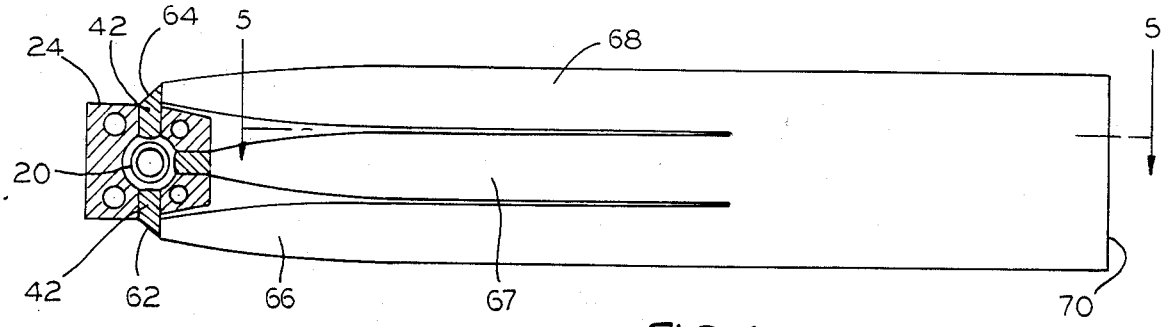
FIG. 4 is an end elevational view in partial section of the embodiment of invention generally shown in FIG. 2 with an optical system of the type contemplated by this invention, namely, light conductors and prisms.

Referring now to the drawing, wherein similar parts are provided with similar numerals, and particularly to FIGS. 1 and 2, an optical radiation source forming illuminator 10 includes a tubular arc lamp 12 of the type wherein a gaseous arc discharge is created between opposite electrodes 14 and 16 by means of an AC electrical power source 18. The arc tube 12 includes a thinwall generally cylindrical central portion 20 that is positioned within the bore 22 of the constricting enclosure or housing 24, with the clearance 23 between the lamp and housing bore being minimal in configuration, for purposes set forth hereinafter. The arc tube 12 is deformed inwardly, at opposite ends of the central portion 20, as indicated at 26. This serves to limit the volume of gas in the tube that is not increased in temperature by the arc and helps to provide a higher operating gas pressure. These factors improve arc lamp efficiency and brightness. Additionally, this constriction also permits use of reflective material at the ends of the arc chamber, which reduces light loss from the ends and further helps to improve efficiency and brightness. Terminal connections 30 are made to the exposed ends of the electrodes 14,16 by means of spring elements 32 which are adapted to accommodate the differential in the coefficient of thermal expansion between the arc lamp 12 and the enclosure 24.

One or both of the terminal connections 30 can be insulated from the housing 24 by use of insulation 34. Additionally, insulating sleeves 36 are used to prevent arcing between terminal connections 30 and housing 24 when high voltage is used to initiate the arc in the tubular arc lamp 12; and heat conducting sleeves 38 encircle the constricted portions 26 of the tube 20 to serve as a means for increasing the conduction of heat generated by the arc in the end regions 52. The open ends of the bore 22 in the enclosure 24 are sealed by end ferrules 40, in a gas tight manner, either by soldering or by the use of high pressure gaskets. The subassemblies of wire 30 and insulating glass 34 plus the ferrule 40 can be purchased as an "insulated lead-in".

The radiation created by the arc tube 12 is transmitted through the housing 24 by the use of one or more light conducting windows 42. Preferably such windows 42 are fabricated from a clear material having good thermal conductivity and a coefficient of thermal expansion compatible with the rate of thermal expansion of the material utilized in the fabrication of housing 24. One such material is an Aluminum Oxide preferably known as synthetic sapphire. The windows, in the preferred embodiment illustrated, are generally rectangular in configuration, for reasons spelled out hereinafter, and are complimentarily accepted in one or more apertures while being sealed to the housing 24 by a suitable sealing/adhesive material 44 that is compatible with and adheres to both the windows 42 and the housing 24. To avoid absorption of the light by the sealing material, the seal surfaces are first coated by a dielectric material that causes total internal reflection within the windows, or, alternatively, the seal surfaces are coated by a highly reflective metallic film. As was indicated above the windows are preferably made of synthetic sapphire to provide good conduction of heat away from the lamp 12. The inner ends of the windows 42 are juxtaposed to the lamp in the same close proximity as the wall of the bore 22 of the housing 24, namely, separated only by the minimal clearance 23, and capable of productive heat transmission from said lamp to the enclosure housing 24 as well as to the opposite end of the windows.

As an additional means for removal of heat from this environment, the enclosure housing 24 is provided with longitudinally extending internal passages 46 that run through the housing 24, at least in the region of the arc tube 20. The passages are connected to input and output conduits 48, 50 for the recirculation of a coolant fluid, such as water. The passages 46 are not limited to the region of the arc tube but can extend for the entire length of the housing 24.

To insure maximum efficiency in the deliverance of light at its highest brightness, the interface between the arc tube lamp 12 and the bore 22 must be provided with radiation reflecting material to reduce the loss of radiation developed by the arc. In the present embodiment, the complete outer surface 21 of the arc tube 20, including its tapered constricted ends 52 down to the constrictions 26, (as best seen in FIG. 3), is coated with a reflecting material except for one or more areas or ports 54 that are disposed to coincide with the one or more windows 42. Light not radiating directly to the windows is thereby reflected and a substantial portion is caused to subsequently be radiated out of the windows or to be reabsorbed in the arc discharge. An alternate arrangement, not shown, has the internal surface of the enclosure bore 22 reflection coated, in which case only the ends 52 of the arc tube 12 need to be coated.

In accordance with the teachings of this invention, the interior bore 22 of the enclosure 24 containing the lamp tube 20 is highly pressurized with a fluid, either gas or liquid, for example, hydrogen, nitrogen or water are suitable. The pressurized fluid fills all voids, including clearance 23, between the lamp 12 and the wall of bore 22. The pressure of this fluid must be at least adequate to counteract that amount of arc lamp internal pressure which, in combination with the stress induced by thermal gradients, would produce excessive stress in thin wall of the tube 20 of the lamp 12. It is likely that such pressure would fall in the range between 1000 and 10,000 psi. One system for establishing such an internal constrictive pressure is shown in FIG. 1 wherein a cylinder 56 of pressurized gas is connected to the bore 22 of the enclosure 24 by means of a tube 58. After establishing the desired internal pressure within bore 22, the tube 58 can be subsequently sealed by fusion of the solder 60 within the tube 58 and thereby permit removal of the cylinder 56.

It will be recognized that it is necessary to provide a gas or vapor under pressure within the tubular portion 20 to create a gaseous arc discharge when an arc is struck between the electrodes 14, 16. The particular gas or vapor chosen will be dependent upon the specific use to be made of the radiation passing through the windows 42. It should be understood that the use of this device is not limited solely to visible light. For example, mercury vapor gives off a large amount of ultraviolet; xenon gas is generally neutral in the visible spectrum but does extend into the infra-red range of the spectrum; while krypton is generally not as efficient as xenon in visible light but has good infra-red qualities. The methods of fabricating sealed arc lamps having such gases or vapors are well known in the art and are not discussed.

Figure 5:
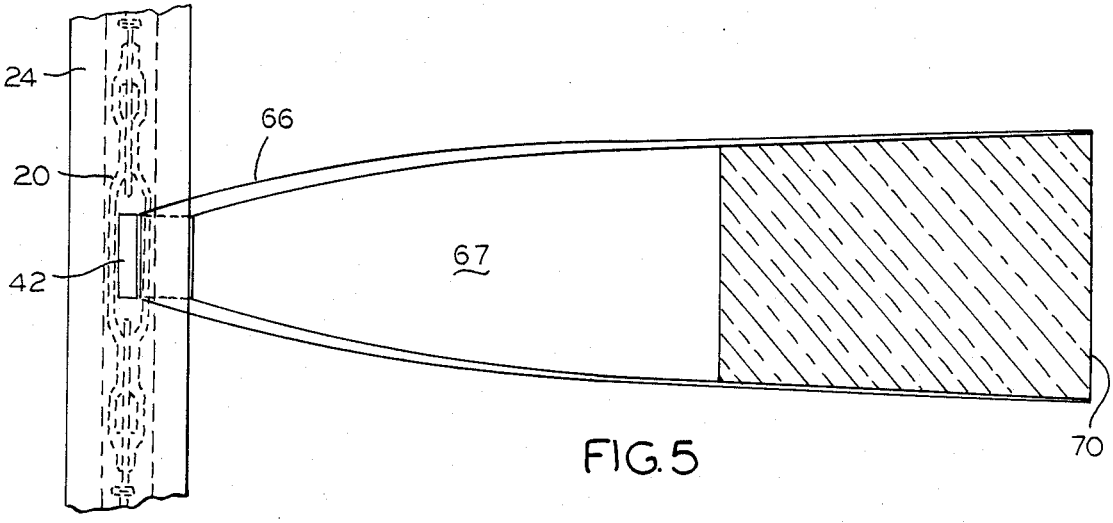
FIG. 5 is a front elevational view in partial section taken along line 5—5 of FIG. 4.

The efficient use of such a source of radiation must include means for conveying the light to its intended use, with a minimum loss of such radiation. Referring now to FIGS. 4 and 5, the light source is schematically shown to include the arc tube 20 and pressurized enclosure 24 with windows 42. Adjacent the oppositely extending windows 42 are a pair of prisms 62, 64 that communicate with elongated generally rectangular light conductors 66, 68, respectively. While the light conductors 66, 68 accept light from the prisms 62, 64 after deflection at approximately right angles by the prisms, an intermediate light conductor 67 accepts light from the third or intermediately disposed window 42. The three conductors 66, 67, 68 combine at their opposite ends to provide a rectangular output format 70 of a low aspect ratio suitable for photographic film projection. The outwardly tapered expansion of conduit cross-section serves to reduce the angular divergence of the light being transmitted. An expansion of approximately three times in width and thickness is capable of reducing the divergence to approximately that suitable for a f/1.8 projection lens, not shown.

Figure 6:
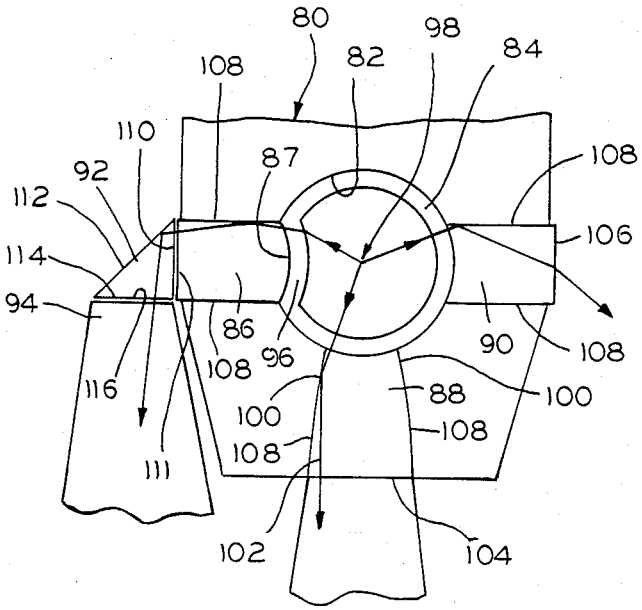
FIG. 6 is a cross-sectional view of an illuminator in the region of the windows (without cross-sectional hatching for clarity in illustration) showing ray traces to illustrate the optical function of a prism in this environment, as well as displaying three differing types of windows.

While the preferred embodiment discussed above utilizes windows 42 which are substantially rectangular, it must be appreciated that other window configurations can be utilized dependent upon the specific end use of the radiation. Similarly, the internal end configurations can be varied to provide differing interfaces with the tube 20. Referring to the schematic illustration in FIG. 6, the enclosure 80 includes a longitudinal bore 82 adapted to accept in close tolerance the tube 84 and three different styles of window, namely, 86, 88, and 90. Also illustrated is the manner in which a prism 92 can be used to deflect light from the window 86 to a light conductor 94 lying at substantially right angles to the principal direction of light emanating from the window. To reduce the angular divergence of the light accepted by the window 86, the window input surface 87 is provided with a convex segmental cylindrical surface. In using this configuration of window 86 the efficiency of the combination is enhanced by having a complimentary concave section 96 in the tube 84 adjacent to and adapted to accept the window 86 in juxtaposed relation. This contact permits good thermal contact between the tube 84 and window 86 as well as causing the concave portion of the wall of tube 84 to act as a lens in conjunction with the window. The concavity also permits the window to be in closer proximity to the arc 98 to thereby improve its collection efficiency.

The window 88 does not have the convex input surface 87 to minimize the divergence of the input light, however, it does make use of reflecting tapered edge surfaces 100 to partially collimate the light rays 102. In doing this the amount of beam expansion required is minimized and the loss of some light by total internal reflection at surface 104 is avoided.

The window 90 has neither an input surface to minimize the input divergence nor edge surfaces to assist in the collimation of the beam. The consequence of this is the loss of some light by internal reflection at the surface 106.

However, by providing reflection at the surfaces 108 and also at the transverse surfaces interconnecting surfaces 108 and extending between opposite ends of the windows serves to cause essentially all input radiation to be transmitted to the output surfaces 104, 106 and 111 of the windows 88, 90 and 86, respectively. The prism 92 is in close proximity to the surface 111 but is separated from it by a thin layer that has a lower index of refraction than the material of the prism. This layer causes light reflected from the prism surface 112 that is subsequently incident on surface 110 to be reflected from it by total internal reflection. Its loss is thereby prevented. This layer does not interfere with the transmission of light from the window to the prism.

The prism deflects the light to the light conductor 94. The prism 92 is also preferably separated from the conductor 94 by a thin transparent layer 114 having a lower index of refraction than the material from which the prism 94 is made. This layer causes total internal reflection of light in the prism that has not yet been incident on the surface 112 of the prism. It thereby prevents the loss of this light through the side surfaces of the light conductor.

Figure 7:
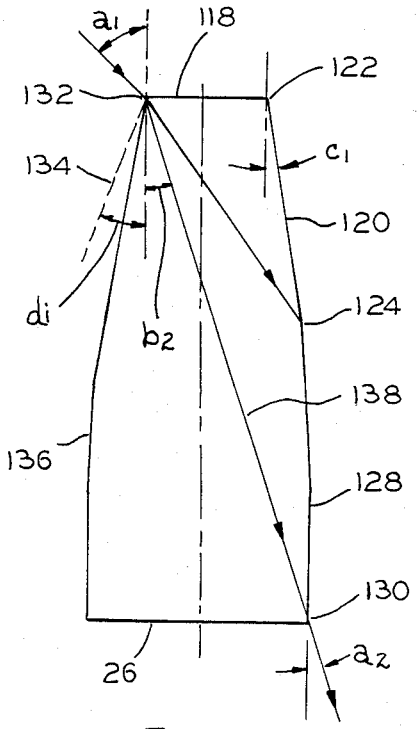
FIG. 7 is an elevational view of a portion of the light conductor shown in FIG. 5 in which ray traces illustrate the optical function of the conductor.

As was previously indicated, the light conductors can serve the function of directing light from several proximity inputs from the lamp to a common output that has an aspect ration reduced from that of the light source. Such conductors can serve the concurrent function of reducing the divergence from that accepted to that convenient for utilization. In FIG. 7, there is found an illustration that provides the function of a light conductor in reducing the divergence of the light with a minimum expansion in area. It is assumed that it is required to accept radiation at the input 118 up to a maximum angle $a_1$ to be directed to the output up to a maximum angle of $a_2$. Light at this input angle is refracted to the input surface to angle $b_1$. The surface 120 between the points defined as 122 and 124 is set at an angle $c_1$ such that the reflected rays when refracted at the output surface 126 will be at the maximum output angle $a_2$. All rays from the input striking this section of surface at a lesser angle will exit at the output at a lesser angle also.

The surface 128 between the points 124 and 130 is a parabola having its focal point at 132 and its axis along the phantom line 134. The angle $d_1$ for this axis is equal to angle $b_2$ which is the refracted angle for the ray having maximum output $a_2$. All rays from point 132 striking this surface between 124 and 130 will be at the maximum output angle. All rays from other points on the input will be at a lesser angle. The procedure for the generation of surface 136 is identical but use is made of point 122 instead of point 132. The length of the light conductor needed for the collimation is established by the intersection of ray 138 with the surface 126, as being the output length.

Figure 9:
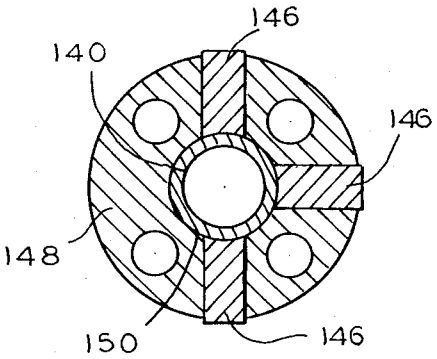
FIG. 9 is a sectional view taken along line 9—9 of FIG. 8.
Figure 8:
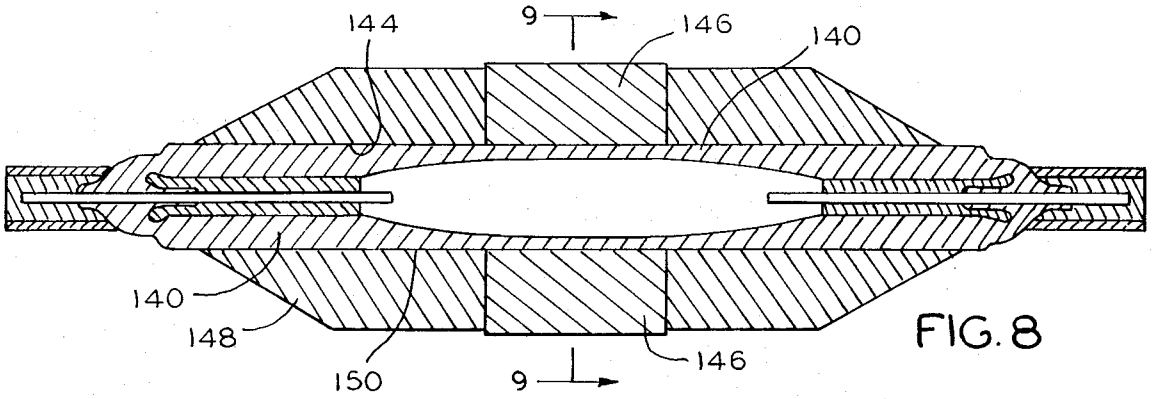
FIG. 8 is an elevational view in section of a second embodiment of the present invention.

A further embodiment of the present invention is best seen in FIGS. 8 and 9, wherein a generally cylindrical tube 140 forming the thin walled arc lamp 142 is intimately engaged by the wall of bore 144 and the inner end of windows 146 in a compressive force relationship by direct contact or contact through a solid interface 150, i.e. a reflective coating. The compression in this arrangement can be brought about by the method of heating the enclosure 148 and inserting a very close fitting lamp 142, possibly with the two members having a slight matching taper. The enclosure 148 on cooling shrinks down upon the lamp and compresses it. If the arc tube is of fused silica, the enclosure is molybdenum and the windows are a synthetic sapphire, a longitudinal and tangential compressive force of close to 30,000 psi. can be exerted on the arc tube 140 if the enclosure 148 is cooled from 600 degrees centigrade. A force of 12,000 psi. is adequate for an arc tube having an OD:ID ratio of 1.20 and an internal pressure of 3,000 psi. The excess pressure allows for an adequate temperature rise of the enclosure during operation of the arc lamp, which temperature rise will cause some reduction in compression by the enclosure 148.

Figure 10:
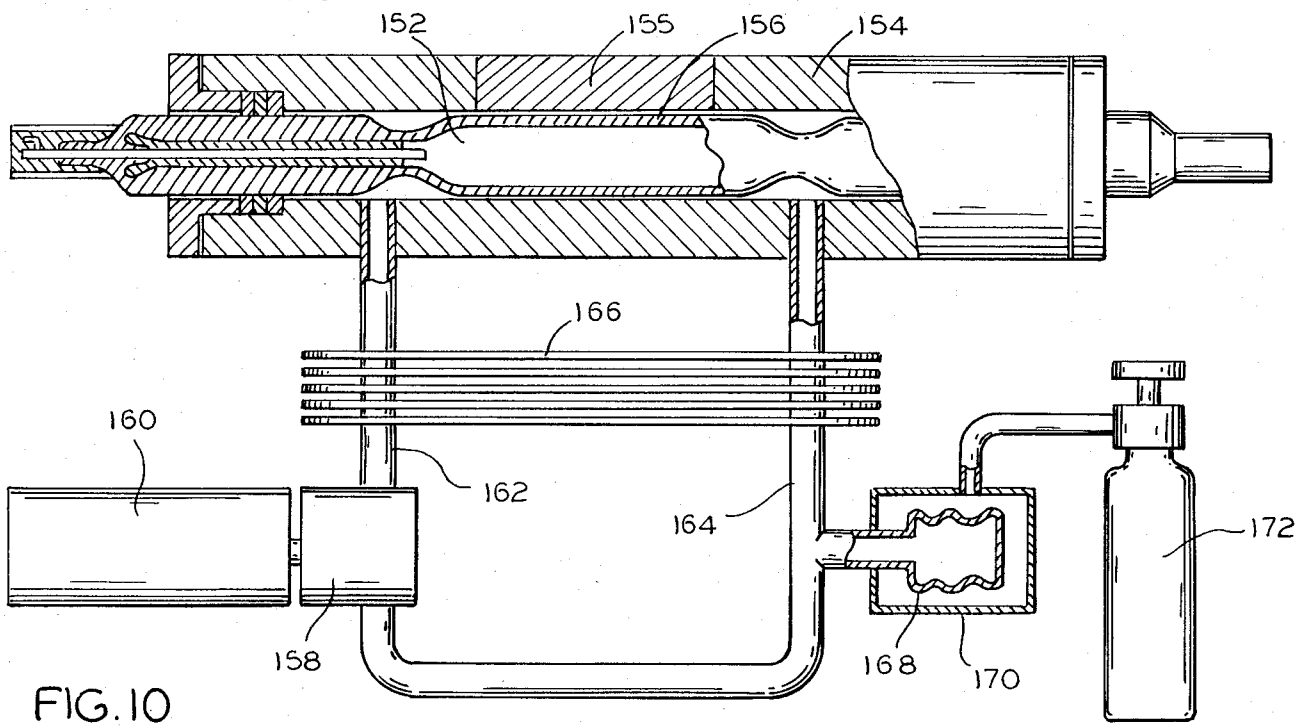
FIG. 10 is an elevational view in partial section of still another embodiment of the present invention wherein cooling of the arc lamp is accomplished by a recirculating high pressure flowing liquid.

An additional embodiment of the present invention is set forth in FIG. 10 wherein the arc lamp 152 is positioned within the sealed enclosure 154 having windows 155. The lamp is cooled by the flow of a fluid, such as water, in the region 156 between the lamp 152 and the enclosure 154. The coolant fluid is circulated by the pump 158 through the pipes 162 and 164 which pass intermediately through a heat exchanger 166 suitably interposed for purposes of cooling the fluid coolant prior to recirculation. Like the other embodiments of this invention, this embodiment requires a high static pressure to be applied by the circulating coolant on the arc lamp to adequately contain same to prevent lamp explosion from internal pressure stress. In this embodiment the force to create a high static pressure is provided by a diaphragm 168, the interior of which is exposed to the coolant being recirculated through pipe 164 and the exterior of which is confronted with the gas pressure within the closed chamber 170. Suitable means such a pressurized gas bottle 172 can be utilized to establish the necessary pressure within chamber 170. Thus, the recirculating fluid in this embodiment serves not only as a coolant but also as the pressure interface between the arc lamp and the enclosure to maintain adequate external support for the lamp and thereby prevent stresses which could result in an explosion. The heat exchanger 166, tubing 162–164, and circulating pump 158 must all be designed to operate at the high static pressure. Preferably, the pump 158 should be driven with a magnetic coupling between it and its motor 160 to permit isolation of the high pressure region.

Figure 11:
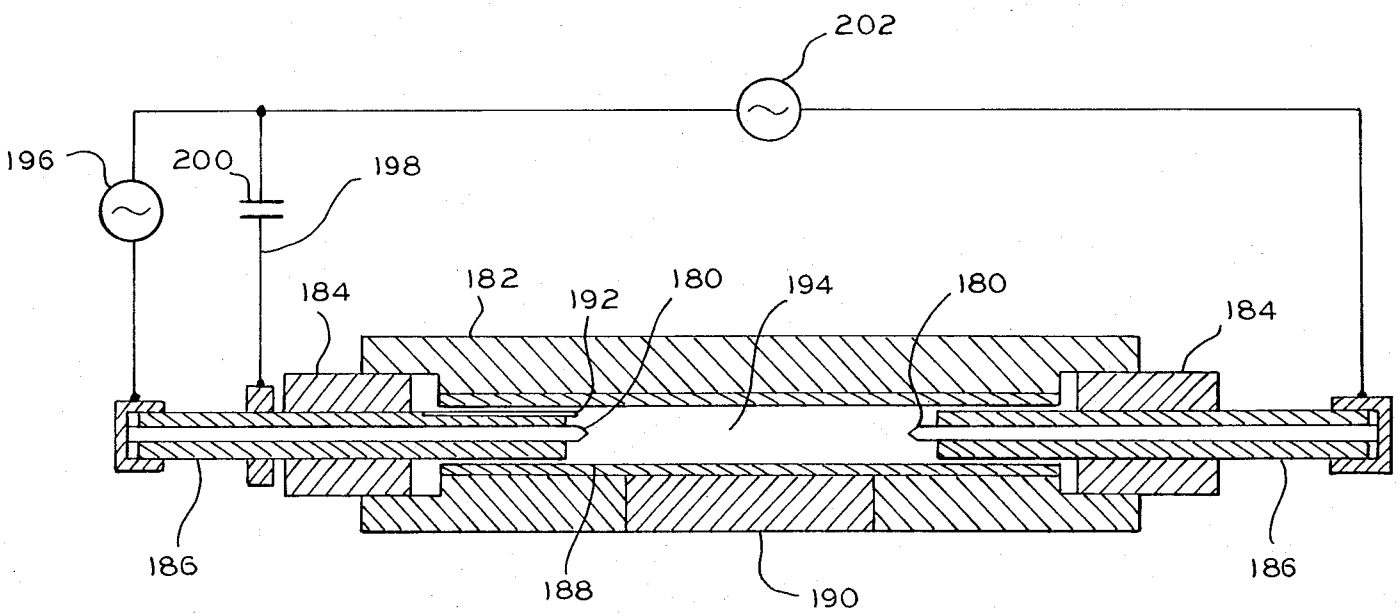
FIG. 11 is an elevational view in section of a further embodiment of the present invention wherein the sealing ferrules serve as the sealing means for both the thinwalled insulating tube and the enclosure.

An additional embodiment of the invention is set forth in FIG. 11, wherein, the arc lamp electrodes 180 are sealed to the enclosure 182 utilizing a sleeve 184 and the tube 186. The arc chamber tube 188 is made of a transparent insulating material such as fused silica, sapphire, or a high temperature glass and is supported by contact with the enclosure 182 and window 190. These latter serve to apply a compressive force to the tube 188 during operation and thereby counteract the tensile forces in it resulting from thermal gradients and internal gas pressure.

This embodiment further incorporates auxiliary electrode means 192 at one end of the arc chamber 194. Means 192 can be used to assist in the initiation of the arc by providing a shorter pathway for the initial gas ionization. Lower starting voltage can then be used which would be less likely to initiate an arc discharge puncturing of the arc chamber wall. An electrical circuit utilizing the auxiliary electrode is shown schematically in FIG. 11. The circuit shown incorporates a source of high voltage 196 for initiating the arc, circuit 198 for passage of current to the auxiliary electrode 192, current limiting capacitor 200 to limit current to the auxiliary electrode 192, and a primary power source 202 to supply the main arc discharge between the electrodes 180 in the arc chamber 194.

Thus, the present invention which has been generally and specifically disclosed hereinabove is a vast improvement over prior existing devices, both in the quality of light transmitted from the radiation device as well as in the optical means utilized to collimate the light and deliver it to the preferred location in an economical properly shaped configuration without appreciable loss thereof. While other embodiments will be apparent to those skilled in the art it is my intent to be limited only by the scope of the appended claims and their equivalents.

I claim:

1. An optical radiation source including a light transmitting electrically insulating tube having an electrode at opposite ends of said tube, pressurized gas within said tube, means for sealing said electrodes to said tube whereby said pressurized gas is retained within said tube, connection means for connecting said electrodes to a suitable source of electrical power to thereby establish a gaseous arc within said tube, an enclosure means having wall means for exerting a compressive force upon said tube adequate to counteract a predetermined internal pressure within said tube that would be in excess of the maximum pressure which said tube could normally withstand, cooling means in contact with said enclosure means and adapted to remove heat transmitted to said enclosure means from said tube, at least one window means in said enclosure means for transmitting light from said tube through said wall means, said enclosure wall means and said at least one window means providing means for facilitation of heat transfer from said tube, in which said enclosure wall means is fabricated from a material having the product of its tensile strength and thermal conductivity being substantially greater than the similar product of the material from which said tube is fabricated, whereby, for the retention of said predetermined pressure of said pressurized gas, the thermal impedance between the inside wall of said tube and said cooling medium is reduced, which reduced thermal impedance permits operation of said tube at a higher than normal power input and a higher than normal brightness.

2. An optical radiation source as set forth in claim 1 wherein a substantial portion of at least one of the facing surfaces of said tube and said enclosure means is reflective to optical radiation except for that portion adjacent said window means.

3. An optical radiation source as set forth in claim 1 wherein a reflective coating is deposited over a substantial portion of the exterior of said tube except for at least one uncoated portion which provides at least one port for the exiting of said radiation.

4. An optical radiation source as set forth in claim 3 wherein said reflective coating on the exterior wall of said tube is chosen from the class of silver or aluminum.

5. An optical radiation source as set forth in claim 1 wherein said enclosure means is metallic in nature and chosen from those metallic materials having adequate tensile strength to withstand the pressure exerted by said tube without explosion thereof and having the requisite thermal conductivity qualities.

6. An optical radiation source as set forth in claim 5 wherein said metallic materials are chosen from the class including but not limited to the following: copper, brass, bronze, molybdenum, iron or nickel iron.

7. An optical radiation source as set forth in claim 1 wherein said enclosure means is spaced a limited relative distance from a substantial portion of said tube, a thin fluid layer interposed under pressure between said tube and said enclosure including said at least one window means, the exertion of force upon said tube and thermal heat transfer to the enclosure means and said at least one window means from said tube is carried out through said thin fluid layer.

8. An optical radiation source as set forth in claim 7 wherein said fluid layer is a substantially non-compressible liquid.

9. An optical radiation source as set forth in claim 8 wherein said liquid is water.

10. An optical radiation source as set forth in claim 7 wherein said fluid layer is a gas under pressure adequate to withstand the possible explosive forces of said pressurized gas in said tube.

11. An optical radiation source as set forth in claim 10 wherein said gas is nitrogen.

12. An optical radiation source as set forth in claim 1 wherein said window means has an interface with said enclosure means where it extends through the wall thereof, said interface being reflective to prevent edge loss of light in transmission of light through said window means.

13. An optical radiation source as set forth in claim 12 wherein both of said enclosure means and said window means are in thermal proximity to said tube to facilitate transfer of heat from said tube during its operation.

14. An optical radiation source as set forth in claim 13 wherein both said enclosure means and said window means are in juxtaposed intimate contact with said tube to facilitate transfer of heat from said tube during its operation.

15. An optical radiation source as set forth in claim 13 wherein said window means is fabricated from a clear material having the characteristics of good light transmission and thermal conductivity.

16. An optical radiation source as set forth in claim 15 wherein said material is chosen from the family of aluminum oxides known as synthetic sapphires.

17. An optical radiation source as set forth in claim 1 wherein said enclosure means includes elongated passage means within its body which are adapted to accept a coolant.

18. An optical radiation source as set forth in claim 17 wherein said passage means are axially located adjacent to at least the arc generating portion of said tube.

19. An optical radiation source as set forth in claim 17 wherein said passage means are located throughout substantially the entire length of said enclosure means.

20. An optical radiation source as set forth in claim 1 wherein said gas is xenon gas.

21. An optical radiation source as set forth in claim 1 wherein said gas is mercury vapor.

22. An optical radiation source as set forth in claim 1 wherein said gas is krypton gas.

23. An optical radiation source as set forth in claim 1 wherein said gas is chosen from those materials which when vaporized in the presence of an arc produce large amounts of ultra violet light.

24. An optical radiation source as set forth in claim 1 wherein said gas is chosen from those gases which when vaporized in the presence of an arc produce large amounts of infra red light.

25. An optical radiation source as set forth in claim 1 wherein said gas is chosen from those gases which produce a substantial high percentage of visible light.

26. An optical radiation source as set forth in claim 1 wherein said at least one window means are associated with external optics adapted to collect radiation from said at least one window means.

27. An optical radiation source as set forth in claim 26 wherein said at least one window means are a plurality of window means circumferentially spaced around said tube and extending through said enclosure means, and said external optics include a number of plate type conduits and prisms equal in number to said plurality of window means to collect the radiation from each of said window means and combine same to provide a radiation output having a reduced length to width ratio.

28. An optical radiation source as set forth in claim 27 wherein said window means are three in number and disposed in quadrature about the axis of the body of said enclosure with two of said window means extending oppositely from one another in substantially 180 degree relation while the third window means bisects the other two and is substantially 90 degrees thereto.

29. An optical radiation source as set forth in claim 28 wherein prisms are provided at each of said window means extending oppositely to one another with said prisms bending the radiation from those two window means to a direction parallel to the direction of radiation of the third said window means, three plate type conduits receiving the radiation from said two prisms and one window means and collecting the radiation and combining the output of said three window means to provide an output having a reduced length to width ratio.

30. An optical radiation source as set forth in claim 29 wherein said conduits are extensions from a common integral body.

31. An optical radiation source as set forth in claim 30 wherein said body is generally rectangular in configuration and said conduits are elongated and extend integrally away from said body in tapered laterally diverging configuration and terminating in a reduced substantially rectangular configuration generally complementary to the external configuration and spacing of said window means and prisms with which they are associated.

32. An optical radiation source as set forth in claim 1 wherein said at least one window means including a generally rectangular body tightly fitted within a complementary opening in said enclosure means, the external one end of said body terminating in a flat generally planar surface generally perpendicular to the side walls of said body and generally co-planar with the exterior of said enclosure means, and a convex inner end complementary to and intimately received within a concave portion of the tube which is locally depressed inwardly of its generally cylindrical configuration to thereby provide an improved optical transmission means.

33. An optical radiation source as set forth in claim 1 wherein said at least one window means is generally rectangular in configuration and complementarily accepted within a bore in said enclosure means, said window means being provided with a substantially planar outer end generally perpendicular to the sides of said rectangular configuration, the opposite or inner end being concave and complementary when juxtaposed to the outer wall configuration of said tube.

34. An optical radiation source as set forth in claim 1 wherein said at least one window means includes an outer substantially planar end disposed generally co-planar with respect to the outside surface of said enclosure means, side walls tapering inwardly away from said planar end and terminating in a concave inner end that is complementary to the tubular configuration of said tube, said window means being complementarily accepted within a tapered bore in said enclosure means and extending between the outer surface thereof and said tube restrained therein.

35. An optical radiation source as set forth in claim 34 wherein said window means includes external optics having conduit means of the plate type, said conduit means having a generally planar end face substantially complementary to said window means said conduit tapering outwardly away from said end face and having an initial taper adjacent said end face substantially equal to the taper of said window means to thereby provide a continuity in the radiation transmission characteristics of said window means.

36. An optical radiation source as set forth in claim 1 wherein said tube is substantially cylindrical in external configuration, said tube is fabricated from a thinwalled material, said enclosure means being a metallic material which is heat shrunk around said tube into juxtaposed relation thereto.

37. An optical radiation source as set forth in claim 36 wherein said enclosure means is sleeve-like having appropriate thermal conductivity, adequate tensile strength to overcome the explosive forces capable of being generated by said tube and a coefficient of thermal expansion which closely matches the coefficient of thermal expansion of said window means.

38. An optical radiation source as set forth in claim 37 wherein said sleeve-like enclosure means is fabricated from a molybdenum-type material and said window means are fabricated from a synthetic sapphire material.

39. An optical radiation source as set forth in claim 7 wherein said enclosure means includes inlet and outlet means communicating between the interior of said enclosure means and the exterior thereof, said inlet and outlet means connected to high pressure circulating means for providing a flow of fluid between said tube and said enclosure means, heat exchange means interpositioned in the fluid circuit between said outlet means and said inlet means to reduce the temperature of said fluid before reintroduction into said enclosure means to cool said tube, and means for adjusting the static pressure of said fluid to at least a pressure adequate to prevent the tube from exploding due to lack of support in said thinwalled construction thereof.

40. An optical radiation source as set forth in claim 39 wherein said means for maintenance of a predetermined static pressure includes diaphragm means internally in communication with said fluid circuit, closed chamber means enclosing the exterior or said diaphragm and in communication with an adjustable pressure source for acting on said diaphragm and thereby controlling the static pressure in the fluid circuit line.

41. An optical radiation source as set forth in claim 40 wherein said fluid is a liquid.

42. An optical radiation source as set forth in claim 41 wherein said liquid is water.

43. An optical radiation source as set forth in claim 39 wherein said high pressure circulating means is a sealed pump connected to its motor solely by a magnetic coupling to permit isolation of the high pressure region.

44. An optical radiation source including a light transmitting electrically insulating tube having thin walls, gas within said tube, electrodes at the ends of said tube, a source of electric power, applying said source of electrical power to said electrodes whereby an arc can be established in said gas within the bore of said insulating tube, a constricting enclosure having wall means for exerting a compressive force upon said insulating tube to counteract tensile strain in said insulating tube whereby said insulating tube is capable of withstanding without fracture a substantially higher gas pressure and a substantially higher thermal gradient within the walls of said insulating tube than is normally possible in such a thinwall tube, at least one window means in said enclosure for transmitting light from said arc discharge within said insulating tube through said enclosure wall means, a cooling means in contact with said enclosure for removing heat transmitted to said enclosure from said tube, said enclosure wall means and said at least one window means providing means for facilitation of heat transfer from said insulating tube when an arc discharge is established therein, said enclosure wall means being fabricated from a material having the product of its tensile strength and thermal conductivity greater than a similar product for the material from which said tube is fabricated, so that, for the retention of a given pressure of said gas, the thermal impedance between the inside surface of the thin wall of said tube and the said cooling means is reduced, which reduced thermal impedance permits operation of the arc within said tube at a higher than normal power input and a higher than normal brightness.

45. An optical radiation source as set forth in claim 44 wherein a substantial portion of at least one of the facing surfaces of said thin walled insulating tube and said enclosure wall means is reflective to optical radiation except for that portion aligned and adjacent said window means and wherein the non-reflective portion adjacent said window means is less than 60% of the outer surface area of said thin walled insulating tube in the region and over the length of the arc discharge.

46. An optical radiation source as set forth in claim 44 wherein said electrodes are sealed to the said insulating tube to confine the pressurized arc discharge gas.

47. An optical radiation source as set forth in claim 44 wherein said electrodes are sealed to said enclosure to confine the arc discharge gas.

48. An optical radiation source as set forth in claim 44 wherein the insulating tube has a wall thickness such that the ratio of wall thickness to outside diameter of said insulating tube is less than one sixth, whereby the transmission of heat from the arc through the tube thin wall is facilitated and whereby the ratio of output brightness from the window means to arc brightness is improved.

49. An optical radiation source as set forth in claim 46 wherein said enclosure is spaced a limited relative distance from a substantial portion of said thin walled insulating tube, a thin transparent fluid layer interposed under pressure between said insulating tube and said enclosure, including said at least one window means, whereby the exertion of force upon the insulating tube and thermal heat transfer to the enclosure and said at least one window means from said insulating tube is carried out through said thin fluid layer.

50. An optical radiation source as set forth in claim 44 wherein a substantial portion of said insulating tube is in direct contact with said enclosure and said at least one window means, whereby compressive force is applied directly to said insulating tube and whereby heat is transmitted from said insulating tube to said enclosure and window means.

51. An optical radiation source as set forth in claim 44 wherein an additional electrode is provided adjacent at least one end of said insulating tube to thereby permit reduced voltage initiation of said arc.

52. An optical radiation source as set forth in claim 44 wherein said thin wall of said insulating tube is chosen from the class consisting of the following: synthetic sapphire, glass or fused silica.

53. An optical radiation source as set forth in claim 44 wherein said at least one window means is associated with external optics adapted to collect radiation from said at least one window means.

54. An optical radiation source as set forth in claim 53 wherein said at least one window means includes a plurality of window means circumferentially spaced around said insulating tube and extending through said enclosure wall means, and said external optics include a number of plate type conduit means equal in number to said plurality of window means to collect the radiation from each of said window means and combine same to provide a radiation output having a reduced length to width ratio.

55. An optical radiation source as set forth in claim 44 wherein said window means are three in number and disposed in quadrature about the axis of the body of said enclosure with two of said window means extending oppositely from one another in substantially 180 degrees relation while the third window means bisects the other two and is substantially 90 degrees thereto.

56. An optical radiation source as set forth in claim 55 wherein prisms are provided at each of said window means extending oppositely to one another with said prisms bending the radiation from those two window means to a direction parallel to the direction of radiation of the third said window means, said conduit means including three plate type conduits receiving the radiation from said two prisms and one window means and collecting the radiation and combining the output of said three window means to provide an output having a reduced length to width ratio.

57. An optical radiation source as set forth in claim 56 wherein said conduit means are extensions from a common integral body.

58. An optical radiation source as set forth in claim 57 wherein said body is generally rectangular in configuration and said conduits are elongated and extend integrally away from said body in a tapered laterally diverging configuration and terminating in a reduced rectangular configuration generally complementary to the external configuration and spacing of said window means and prisms with which they are associated.

* * * * *